US008894429B2

(12) United States Patent
Jackson

(10) Patent No.: US 8,894,429 B2
(45) Date of Patent: Nov. 25, 2014

(54) EARTH BUSBAR

(75) Inventor: Neil Jackson, Launceston (GB)

(73) Assignee: Control Techniques Ltd, Newtown (GB)

( * ) Notice: Subject to any disclaimer, the term of this patent is extended or adjusted under 35 U.S.C. 154(b) by 98 days.

(21) Appl. No.: 13/560,292

(22) Filed: Jul. 27, 2012

(65) Prior Publication Data

US 2013/0115789 A1 May 9, 2013

(30) Foreign Application Priority Data

Nov. 4, 2011 (GB) ..... 1119160.8

(51) Int. Cl.

| | |
|---|---|
| ***H01R 4/60*** | (2006.01) |
| ***H01R 4/64*** | (2006.01) |
| ***H01R 9/24*** | (2006.01) |
| ***H01R 25/16*** | (2006.01) |
| ***H01R 12/58*** | (2011.01) |
| ***H01R 4/34*** | (2006.01) |
| *H01R 11/09* | (2006.01) |

(52) U.S. Cl.

CPC ..... *H01R 4/64* (2013.01); *H01R 9/2458* (2013.01); *H01R 11/09* (2013.01); *H01R 25/16* (2013.01); *H01R 9/24* (2013.01); *H01R 12/58* (2013.01); *H01R 4/34* (2013.01)

USPC ..... 439/212

(58) Field of Classification Search

USPC ..... 439/212, 949; 351/637, 648

See application file for complete search history.

(56) References Cited

U.S. PATENT DOCUMENTS

| | | | | |
|---|---|---|---|---|
| 4,627,677 | A * | 12/1986 | Ono et al. | 439/75 |
| 4,927,367 | A * | 5/1990 | Salvagno | 439/92 |
| 5,381,598 | A * | 1/1995 | Adachi et al. | 29/845 |
| 6,040,976 | A * | 3/2000 | Bruner et al. | 361/611 |
| 6,186,800 | B1 * | 2/2001 | Klein et al. | 439/95 |
| 6,322,400 | B1 * | 11/2001 | Perry et al. | 439/723 |
| 6,358,099 | B1 * | 3/2002 | Kolody et al. | 439/716 |
| 6,560,123 | B1 * | 5/2003 | de Varennes et al. | 361/807 |
| 7,044,755 | B2 * | 5/2006 | Hatakeyama | 439/97 |
| 7,049,970 | B2 * | 5/2006 | Allen et al. | 340/590 |
| 7,371,085 | B2 * | 5/2008 | Yonekawa | 439/97 |
| 8,199,528 | B2 * | 6/2012 | Tachikawa et al. | 361/816 |
| 8,295,054 | B2 * | 10/2012 | Lu | 361/759 |
| 8,398,412 | B2 * | 3/2013 | Dolhagaray et al. | 439/76.1 |
| 8,777,642 | B2 * | 7/2014 | Pujol et al. | 439/97 |

FOREIGN PATENT DOCUMENTS

DE 4303793 8/1994

* cited by examiner

*Primary Examiner* — Neil Abrams
*Assistant Examiner* — Travis Chambers
(74) *Attorney, Agent, or Firm* — Harness, Dickey & Pierce, P.L.C.

(57) ABSTRACT

A device for use with a printed circuit board, PCB, is provided. The device is arranged to electrically connect to a component on the PCB. The device comprises a first layer having a first hole therethrough and a second layer having a second hole therethrough. The second hole is arranged to receive a connector to connect the device to the PCB. Each of the first and second holes has a width in the plane of the respective first or second layer. The first and second holes are substantially coaxial. The width of the first hole is greater than the width of the second hole. Thus proper electrical clearance is provided between the component on the PCB an the device when the connector is not present.

17 Claims, 3 Drawing Sheets

EARTH BUSBAR

CROSS-REFERENCE TO RELATED APPLICATION

This application claims the benefit and priority of British Patent Application No. GB1119160.8 filed Nov. 4, 2011. The entire disclosure of the above application is incorporated herein by reference.

FIELD

The invention relates to an earth busbar. In particular, the invention relates to reducing leakage of current from an electrical contact on a printed circuit board (PCB) to an earth busbar when the electrical contact is not connected to the earth busbar.

BACKGROUND

A busbar is typically a strip of conducting material for use in an electrical apparatus. A busbar may be electrically connected to a PCB to provide a return path for electrical current for electrical components on the PCB. Such a busbar is referred to herein as an earth busbar.

A busbar typically has a number of electrical connections to respective electrical contacts on a surface of a PCB. Most typically three electrical connections are made from the busbar to three respective electrical contacts on a PCB. Each connection is realized by a threaded screw, comprising a conductive material, which is inserted through a hole in the PCB and received into the busbar. The head of the screw contacts the respective electrical contact on the surface of the PCB. The first connection is a conventional earth connection, which will be used in most applications. The second connection is for connecting an electromagnetic compatibility (EMC) capacitor to earth. The third connection is for connecting a metal oxide varistor (MOV) to earth.

In some applications, it may be desirable not to have the second or third connection at least some of the time. For example, electrical noise in a circuit may be reduced by removing the EMC capacitor. An MOV provides protection from transient voltages, which may result from a lightning strike, for example. In some applications, for example on a ship, the power supply is isolated and so such protection is not required.

In applications where the second or third connection is not used, a sufficiently large gap between the second or third electrical contact on the PCB and the conducting material of the earth busbar must be maintained to ensure proper electrical clearance and to prevent current leakage from the PCB to the earth busbar. According to known methods, the gap is typically maintained by inserting an insulating spacer between the PCB and the earth busbar during installation.

The insulating spacer is typically formed of a thermoplastic material. The spacer is therefore subject to creep over time, which can cause the connector between the PCB and the busbar to come loose, resulting in a poor electrical connection. Furthermore, the spacer adds complexity to the installation process, and is sometimes omitted from the installation entirely because of human error. When the spacer is omitted, leakage currents can flow between the PCB and the busbar even when no connecting screw has been installed, producing unpredictable and undesirable consequences.

An invention is set out in the claims.

SUMMARY

A device for use with a printed circuit board, PCB, is provided. The device is arranged to electrically connect to a component on the PCB. The device comprises a first layer having a first hole therethrough and a second layer having a second hole therethrough. The second hole is arranged to receive a connector to connect the device to the PCB. Each of the first and second holes has a width in the plane of the respective first or second layer. The first and second holes are substantially coaxial. The width of the first hole is greater than the width of the second hole.

An assembly is provided. The assembly comprises a PCB, a device and a first connection between the PCB and the device. The device comprises a first layer having a first hole therethrough and a second layer having a second hole therethrough. The second hole is arranged to receive a connector to form a second connection between the device and the PCB. Each of the first and second holes has a width in the plane of the respective first and second layer. The first and second holes are substantially coaxial. The width of the first hole is greater than the width of the second hole.

Thus, when the connector is absent, the first layer of the device provides electrical clearance between a component on a PCB and the second layer by spacing the second layer from the PCB. Furthermore, the width of the first hole, which is greater than the width of the second hole, provides electrical clearance between the component on the PCB and the first layer.

Thus, when the device is connected to a PCB but there is a contact on the PCB that is not to be electrically connected to the device, all portions of the device are separated from the electrical contact on the PCB to provide electrical clearance without requiring additional spacers. Eliminating the need for additional spacers between the PCB and the device allows for easier installation, and reduces the risk of improper installation through human error, resulting in a safer and more effective device.

The first and second layers of the device may be integrally formed. The first and second layers of the device may be formed of a continuous sheet of material. The continuous sheet of material may be folded to form the first and second layers. Because the device is formed of a single, folded sheet of material, it is simple and inexpensive to manufacture.

The first and second layers of the device may be formed of a conducting material. Thus the "spacer" (the first layer of the device) is not a thermoplastic and is not subject to creep over time. Therefore the device retains its structure and a connection between the device and a PCB will remain secure, even over a long period of time. The first layer may comprise an electrically conductive portion surrounding the first hole.

The second layer of the device may comprise a lip. The lip may surround the second hole in the second layer. The lip may be arranged to receive the connector. The lip provides a larger contact area between the second layer of the device and a connector, thereby providing both a secure electrical connection between an electrical component on the PCB and the device and a secure mechanical connection between the PCB and the device.

The first and second layers of the device may be substantially planar. The first and second layers may be substantially parallel to one another.

The device may be a busbar. The device may be an earth busbar.

DRAWINGS

Embodiments and aspects will now be described with respect to the figures, of which:

DETAILED DESCRIPTION

Figure 1:
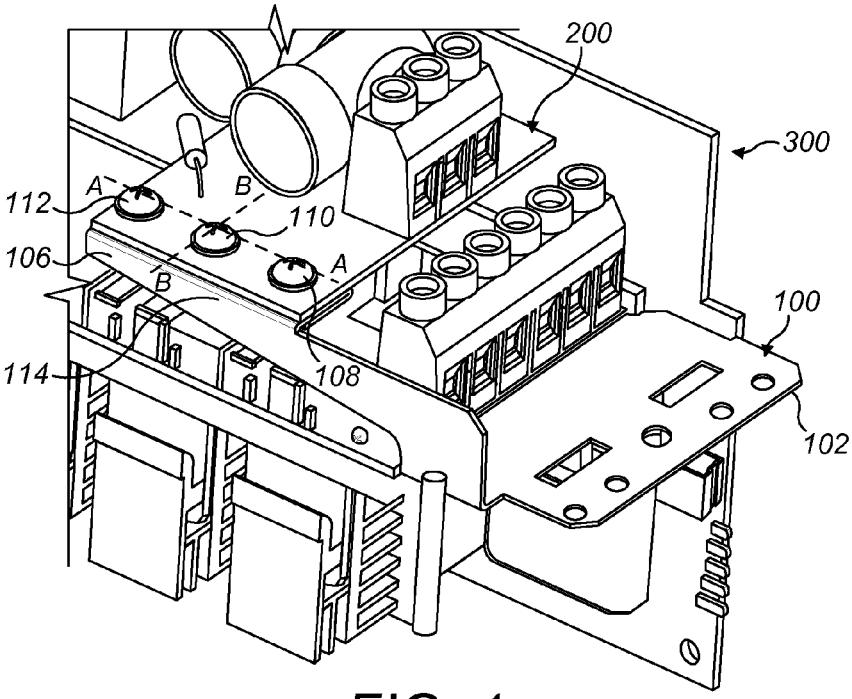
FIG. 1 shows a perspective view from the front left-hand-side of an earth busbar and a PCB installed in a housing.
Figure 2:
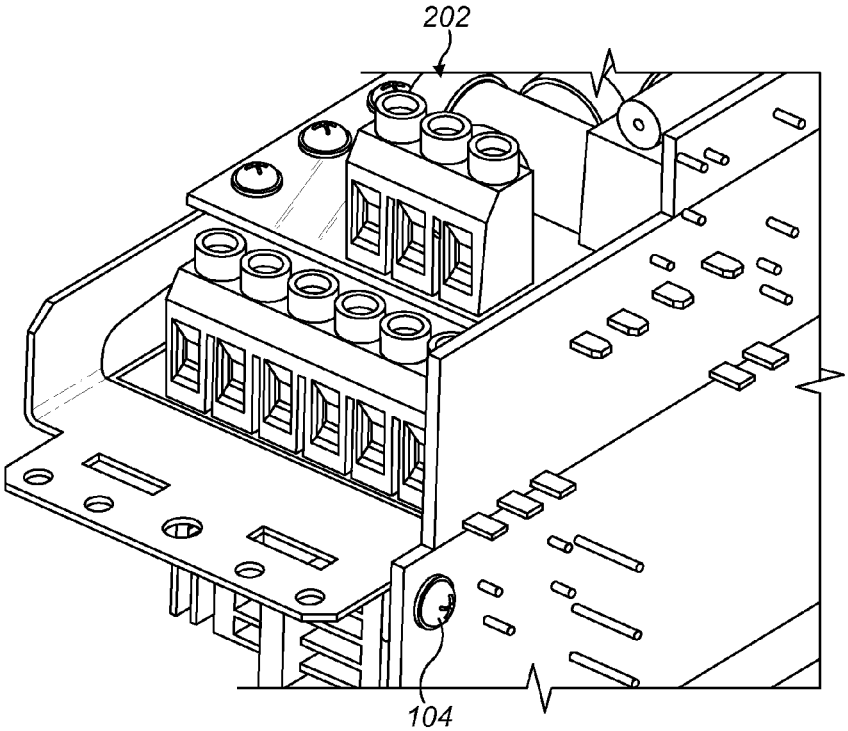
FIG. 2 shows a perspective view from the front right-hand-side of the earth busbar and the PCB.

FIG. 1 shows a busbar 100 and PCB 200 installed in a housing 300. A first end 102 of the busbar 100 is connected to the housing 300 via a screw 104, as shown in FIG. 2. A second end 106 of the busbar 100 is connected to the PCB 200 via screws 108, 110 and 112. A number of electrical components 202 are mounted on the PCB 200. The busbar 100 provides an earth connection between the electrical components 202 on the PCB 200 and the housing 300.

Figure 3:
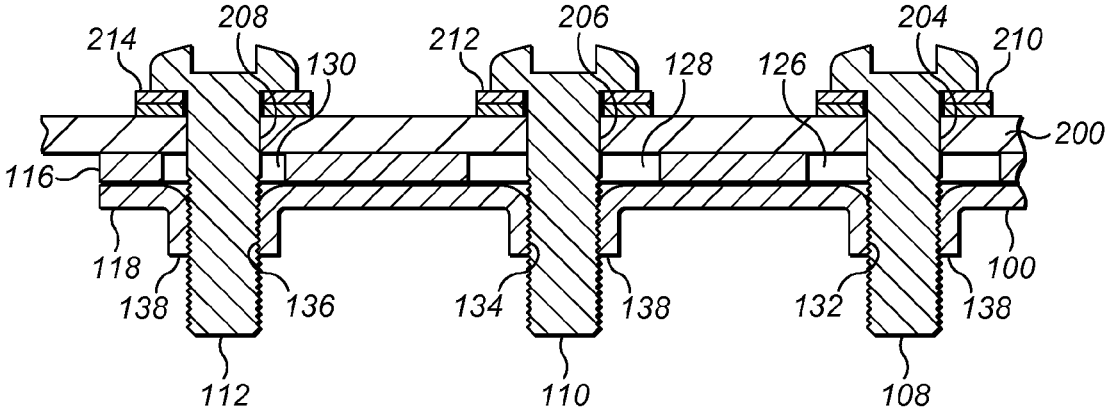
FIG. 3 shows the earth busbar and PCB in cross section along the line A-A.

The first end 102 of the busbar 100 as shown in FIGS. 1 to 3 herein comprises a substantially planar portion having a plurality of gaps therein. It sits substantially horizontally at the front of the housing 300. A wall extends substantially vertically upwards from one side of the substantially planar portion. An upper part of that wall extends laterally and rearwards, away from the first end 102 of the busbar 100 towards the second end 106 of the busbar 100.

The description below focuses on the features at the second end 106 of the busbar 100.

Figure 4:
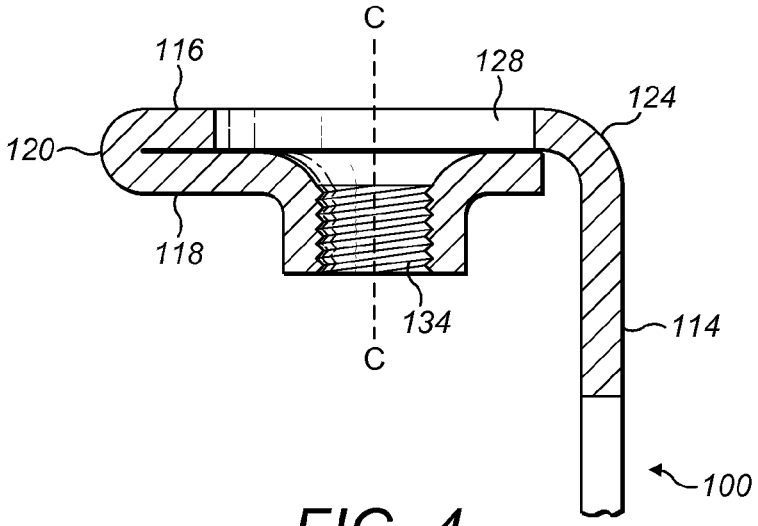
FIG. 4 shows the earth busbar in cross section along the line B-B, without the other components shown in FIGS. 1 to 3.

FIG. 4 shows a cross-sectional view of the second end 106 of the busbar 100 along the line A-A shown in FIG. 1, but without the other features depicted in FIG. 1 being present. The busbar 100 comprises a wall section 114, an upper layer 116 and a lower layer 118. In the embodiment shown in FIG. 4, the wall section 114, the upper layer 116 and the lower layer 118 are formed of a single, continuous sheet of conducting material. The wall section 114 and the upper layer 116 are joined via a first bend or fold 124 of the conducting material. The upper layer 116 and the lower layer 118 are joined via a second bend or fold 120 of the conducting material. Both folds have curved profiles, with the first fold 124 being approximately 90° and the second fold 120 being approximately 180°.

Figure 5:
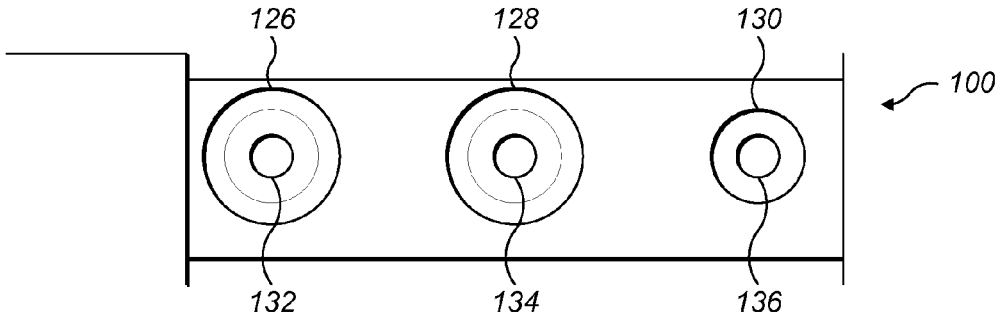
FIG. 5 is a plan view of the earth busbar, when not installed in a housing.
Figure 6:
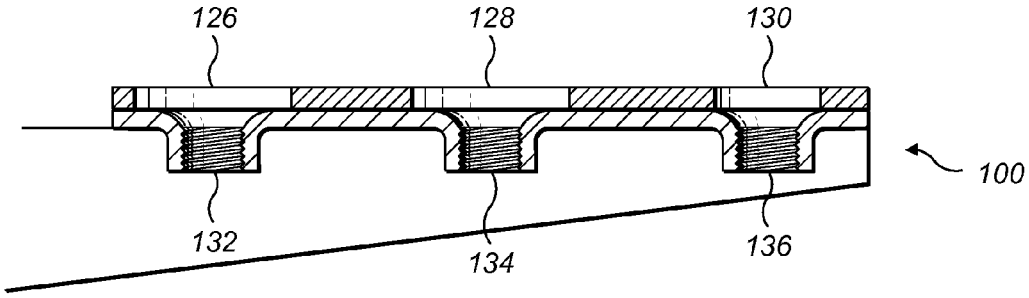
FIG. 6 shows a view of the earth busbar in cross section along the line A-A, when not installed in a housing.
Figure 7:
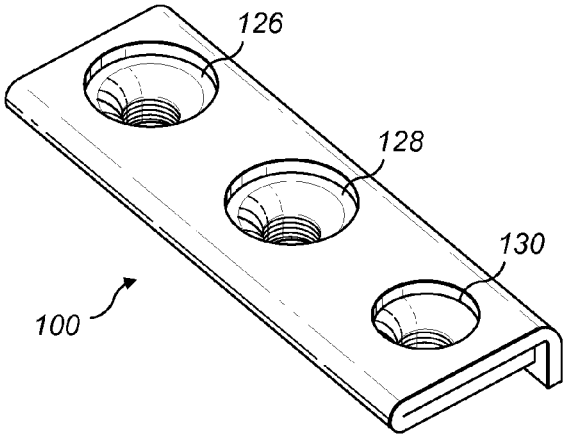
FIG. 7 shows a perspective view from the rear right-hand-side of the earth busbar, when not installed in a housing.

As can be seen in FIGS. 3, 5 and 6, the upper layer 116 of the busbar 100 has three holes 126, 128 and 130 located therein. The holes 126, 128 and 130 in the upper layer 116 of the busbar 100 are arranged to correspond to holes 204, 206 and 208 located in the PCB 200, such that holes 126, 128 and 130 are substantially coaxial with holes 204, 206 and 208, respectively, when the busbar 100 and PCB 200 are aligned.

With reference to FIGS. 3, 4 and 6, the lower layer 118 of the busbar 100 also has three holes 132, 134 and 136 located therein. The holes 132, 134 and 136 in the lower layer 118 correspond to and are substantially coaxial with the holes 126, 128 and 130 in the upper layer 116 of the busbar 100. The first 126 and second 128 holes in the upper layer 116 of the busbar 100 each have a diameter larger than the diameter of the first 132 and second 134 holes in the lower layer 118 respectively.

Each of the holes 132, 134 and 136 in the lower layer 118 of the busbar 100 is surrounded by a lip portion 138. The lip portions 138 extend downwardly from the lower layer 118 of the busbar 100 in a direction substantially perpendicular to the plane of the lower layer 118 and away from the upper layer 116 of the busbar 100.

The PCB 200 is provided with first 210, second 212 and third 214 solder pads, which surround the first 204, second 206 and third 208 holes in the PCB 200, respectively. The diameter of the inner surface of each of the first 210, second 212 and third 214 solder pads is larger than the respective diameter of the first 204, second 206 and third 208 holes in the PCB 200. Thus, the solder pads 210, 212 and 214 are set back from the edges of the holes 204, 206 and 208, respectively, which increases the distance between the solder pads 210, 212 and 214 and the busbar 100, providing increased electrical clearance. Each of the solder pads 210, 212 and 214 can be electrically connected to one or more of the electrical components 202 on the PCB 200 as required.

In operation, screws 108, 110 and 112 are inserted through the solder pads 210, 212 and 214, the holes 204, 206 and 208 in the PCB 200 and the holes 126, 128 and 130 in the upper layer 116 of the busbar 100, and are received by the lip portions 138, which define and surround the holes 132, 134 and 136 of the lower layer 118. The lip portions 138 are tapped to receive the threads of the screws. The screws 108, 110 and 112 and the lip portions 138 provide a secure mechanical connection between the busbar 100 and the PCB 200. Furthermore, a reliable electrical connection is provided between the electrical components 202 and the busbar 100, via the solder pads 210, 212, 214, the screws 108, 110, 112 and the lip portions 138.

The first screw 108, solder pad 210, PCB hole 204, upper layer hole 126 and lower layer hole 132 are provided for connecting an MOV to earth. The second screw 110, solder pad 212, PCB hole 206, upper layer hole 128 and lower layer hole 134 are provided for connecting an EMC capacitor to earth. The third screw 112, solder pad 214, PCB hole 208, upper layer hole 130 and lower layer hole 136 are provided for connecting other electrical components 202 on the PCB 200 to earth.

When one or both of the first 108 and second 110 screws are not present, the busbar described above provides the required electrical clearance between the solder pads 210, 212 and the busbar 100 by ensuring that any conducting portions of the busbar 100 are located far enough away from the solder pads 210, 212. This achieved by the inclusion of the upper layer 116, which acts as a (vertical) spacer between the PCB 200 and the lower layer 118, maintaining the conducting portions of the lower layer 118 which are most proximal to the solder pads 210, 212 in a substantially vertical direction at a required distance from the solder pads 210, 212 to ensure sufficient electrical clearance. Furthermore, because the diameter of the holes 126, 128 in the upper layer 116 is larger than the diameter of the holes 132, 134 in the lower layer 118, the conducting portions of the upper layer 116 which are most proximal to the solder pads 210, 212 in a substantially vertical direction are far enough away from the solder pads 210, 212 in a lateral (or substantially horizontal) direction to ensure the required electrical clearance.

The holes 126, 128 and 130 in the first layer 116, the holes 132, 134 and 136 in the second layer 118 and the holes 210, 212 and 214 in the PCB 200 respectively are also laterally spaced apart from one another to provide electrical clearance between, for example, the second solder pad 212 and the portion of the upper layer 116 surrounding the first hole 126.

Because the screw 112 is always present when the busbar 100 and PCB 200 are in use, it is not necessary for the diameter of the hole 130 in the upper layer 116 to be larger than the diameter of the hole 136 in the lower layer 118; no electrical clearance is required.

Because the busbar 100 comprises a single, folded piece of material, it is simple and inexpensive to manufacture. For example, the holes 126, 128, 130, 132, 134 and 136 may be cut into a sheet of material using a die and press, or they may be drilled. In the case of a die and press, the lip portions 138 are formed by the die in the same process. In the case that the holes 126, 128, 130, 132, 134 and 136 are drilled, the lip portions 138 are formed in a subsequent die and press process. Once the holes 126, 128, 130, 132, 134 and 136 have been formed, the sheet of material is folded to form the upper 116 and lower 118 layers such that the holes 126, 128 and 130 are substantially coaxially aligned with the holes 132, 134 and 136, respectively.

The holes 132, 134 and 136 in the lower layer 118 are small enough to fit tightly with the screws 108, 110 and 112, thereby providing a secure electrical and mechanical connection. The holes 126 and 128 in the upper layer 116 are large enough to provide lateral electrical clearance when the busbar 100 is connected to the PCB 200 and when one of the screws 108, 110 is not present. The upper layer 116 is thick enough and sufficiently spaced from the lower layer 118 to provide electrical clearance between the lower layer 118 and the PCB 200 in a vertical direction.

The skilled reader will be familiar with how to calculate the required electrical clearance distance, which is a function of the voltage difference between the solder pads 210, 212, 214 on the PCB 200 and the busbar 100. For example, recommended voltage spacings are laid down in the relevant standards documents for electrical circuits. Thus the skilled person could construct the busbar 100 disclosed herein with appropriate dimensions to provide the electrical clearance necessary for a particular application in which the busbar 100 is intended to be used.

In the embodiment described herein, each of the upper 116 and lower 118 layers are formed from zinc-plated, passivated steel. Each of the upper 116 and lower 118 layers has a thickness of between approximately 0.8 mm and approximately 1.6 mm. Each of the holes 126 and 128 in the upper layer 116 may have a diameter of approximately 8 mm. However, the diameters of the holes 126 and 128 may be greater or less than 8 mm, depending on the diameter of the screws 108 and 110. The screws 108, 110, 112 are ISO standard M3 or M4×8 to 16. The PCB 200 is approximately 1.6 mm thick.

Whilst the above embodiment has been described as having screws 108, 110, 112 as forming the electrical and mechanical connections between the busbar 100 and the PCB 200, any form of mechanical and/or electrical connection can be employed. Alternatively, the electrical connection and the mechanical connection between the busbar 100 and the PCB 200 may be achieved separately. Furthermore, there may be fewer than the three sets of solder pads 210, 212, 214, screws 108, 110, 112, holes 204, 206, 208 in the PCB 200, holes 126, 128,130 in the upper layer 116 and holes 132,134,136 in the lower layer 118 depicted herein, or there may be more. Additional sets of solder pads, holes and screws may be used to removably connect electrical components on the PCB 200 other than the MOV or EMC capacitor described above to earth; these other electrical components may be provided in addition to or in place of the MOV and the EMC capacitor.

Optionally, the lip portions 138 surrounding the holes 132, 134, 136 in the lower layer 118 may be omitted. If the lip portions 138 are omitted, the portions of the lower layer 118 surrounding the holes 132, 134, 136 may be tapped to receive the threads of the screws 108, 110, 112, respectively.

Although the folds 120 and 124 are depicted as having a curved profile, they may instead be angular or less curved. Alternatively, in place of the fold described above, the upper 116 and lower 118 layers may be joined using known welding or soldering techniques. Alternatively, the upper 116 and lower 118 layers may be integral, and the holes 126, 128, 130 in the upper layer and the holes 132, 134, 136 in the lower layer may comprise three single counterbored holes. It is not necessary to provide a gap between the upper 116 and lower 118 layers in a vertical direction.

The first end 102 of the busbar 100 may be different to the first end 102 described above, or it may not be present at all.

Whilst the device 100 has been described as a "busbar", another name could be used for the device 100. The device 100 is a conductor for connecting electrical components on a PCB to earth.

The relative terms "front", "rear", "right-hand-side", "left-hand-side", "upper", "lower", "vertical", "lateral" and "horizontal" used herein relate to the orientation of the device as shown in the Figures and are employed to facilitate description of the device. They are not intended to be limiting.

An embodiment has been described herein by way of example only. It will be appreciated that variations of the described embodiment may be made which are still within the scope of the invention.

The invention claimed is:

1. A device for use with a printed circuit board, PCB, the device being arranged to electrically connect to a component on the PCB and comprising:

a first layer having a first hole therethrough, and a second layer in contact with the first layer and having a second hole therethrough, the second hole arranged to receive a connector to connect the device to the PCB, wherein the first and second layers are formed of a conductive material, wherein the conducting material of the first layer and the conducting material of the second layer form a continuous sheet of material, wherein each of the first and second holes has a width in the plane of the respective first or second layer, wherein the first and second holes are substantially coaxial and wherein the width of the first hole is greater than the width of the second hole.

2. The device of claim 1, wherein the first layer and the second layer are integrally formed.

3. The device of claim 1, wherein the continuous sheet of material is folded to form the first and second layers.

4. The device of claim 1, wherein the second layer comprises a lip, wherein the lip surrounds the second hole, and wherein the lip is arranged to receive the connector.

5. The device of claim 1, wherein the device is arranged to be electrically connected to earth.

6. The device of claim 1, wherein the first layer has a depth, wherein the first layer is arranged so that, when the first layer is provided intermediate the PCB and the second layer of the device, and when a connector is not received in the second hole, the depth of the first layer provides an electrical clearance between the second layer and an electrical contact on the PCB.

7. The device of claim 1, wherein the first layer comprises an electrically conductive portion surrounding the first hole, the first layer being arranged so that, when a connector is not received in the second hole, the width of the first hole provides electrical clearance between the electrically conductive portion and an electrical contact on the PCB.

8. The device of claim 1, wherein the first layer comprises a plurality of first holes and the second layer comprises a plurality of second holes.

9. An assembly comprising:

a printed circuit board, PCB, a device arranged to electrically connect to a component on the PCB, and a first connection between the PCB and the device, the device comprising:

a first layer having a first hole therethrough, and a second layer in contact with the first layer and having a second hole therethrough, the second hole arranged to receive a connector to form a second connection between the device and the PCB, wherein the first and second layers are formed of a conductive material, wherein each of the first and second holes has a width in the plane of the respective first or second layer, wherein the first and second holes are substantially coaxial, and wherein the width of the first hole is greater than the width of the second hole.

10. The assembly of claim 9, wherein the first layer and the second layer are integrally formed.

11. The assembly of claim 9, wherein the second layer comprises a lip, wherein the lip surrounds the second hole, and wherein the lip is arranged to receive the connector.

12. The assembly of claim 9, wherein the device is arranged to be electrically connected to earth.

13. The assembly of claim 9, wherein the first layer is provided intermediate the PCB and the second layer, and wherein the first layer has a depth, wherein the first layer is arranged so that, when a connector is not received in the second hole, the depth of the first layer provides an electrical clearance between the second layer and an electrical contact on the PCB.

14. The assembly of claim 9, wherein the first layer comprises an electrically conductive portion surrounding the first hole, the first layer being arranged so that, when a connector is not received in the second hole, the width of the first hole provides electrical clearance between the electrically conductive portion and an electrical contact on the PCB.

15. The assembly of claim 9, wherein the first layer comprises a plurality of first holes and the second layer comprises a plurality of second holes.

16. The assembly of claim 9, wherein the conducting material of the first layer and the conducting material of the second layer form a continuous sheet of material.

17. The assembly of claim 16, wherein the continuous sheet of material is folded to form the first and second layers.

* * * * *